US010924827B2

(12) United States Patent
Dong et al.

(10) Patent No.: US 10,924,827 B2
(45) Date of Patent: Feb. 16, 2021

(54) MOBILE TERMINAL

(71) Applicant: AAC Technologies Pte. Ltd., Singapore (SG)

(72) Inventors: Xianjie Dong, Shenzhen (CN); Long Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/706,789

(22) Filed: Dec. 8, 2019

(65) Prior Publication Data

US 2020/0221196 A1 Jul. 9, 2020

(30) Foreign Application Priority Data

Dec. 24, 2018 (CN) ..... 201822179107.3

(51) Int. Cl.
*H04R 1/02* (2006.01)

(52) U.S. Cl.
CPC ..... *H04R 1/021* (2013.01); *H04R 1/025* (2013.01); *H04R 1/026* (2013.01); *H04R 2201/021* (2013.01)

(58) Field of Classification Search
CPC ..... H04R 1/025; H04R 1/026; H04R 1/021; H04R 2201/021
See application file for complete search history.

(56) References Cited

U.S. PATENT DOCUMENTS

| | | | | |
|---|---|---|---|---|
| 9,820,034 | B1 * | 11/2017 | Zhang | H04R 1/025 |
| 2019/0014405 | A1 * | 1/2019 | Qin | H04R 31/00 |
| 2019/0014406 | A1 * | 1/2019 | Qin | H04R 1/025 |
| 2020/0045399 | A1 * | 2/2020 | Wu | H04R 1/288 |
| 2020/0162811 | A1 * | 5/2020 | Zheng | H04R 1/345 |
| 2020/0162812 | A1 * | 5/2020 | Zheng | H04R 1/2842 |
| 2020/0213697 | A1 * | 7/2020 | Zhang | H04R 1/2873 |

* cited by examiner

*Primary Examiner* — Regina N Holder
(74) *Attorney, Agent, or Firm* — W&G Law Group LLP

(57) ABSTRACT

The present invention provides a mobile terminal, including: a housing including an upper cover, a lower cover covering the upper cover to form an accommodating space, and a sound channel penetrating through the upper cover; and a speaker unit accommodated in the accommodating space of the housing; the speaker unit dividing the accommodating space into a front sound cavity and a rear cavity; the sound channel communicating the front sound cavity with an outside; and where in, the speaker unit is fixed on the upper cover and enclosed together with the upper cover to from the front sound cavity; the sound channel is filled with a sound absorbing material.

4 Claims, 4 Drawing Sheets

A-A

MOBILE TERMINAL

TECHNICAL FIELD

The present invention relates to an electro acoustic field, and in particular to a mobile terminal.

BACKGROUND

With the advent of mobile internet era, a number of smart mobile devices continue to rise. Among the many mobile devices, mobile phones are undoubtedly the most common and portable mobile terminal devices. At present, functions of the mobile phones are extremely diverse, one of which is a high-quality music function, so a mobile terminal for playing sound is widely used in today's smart mobile devices.

The mobile terminal in the prior art comprises a housing having an accommodating space and a speaker unit accommodated in the housing. The speaker unit divides the accommodating space into a front sound cavity and a rear cavity. The housing comprises a sound channel penetrating through the housing. The sound channel communicates the front sound cavity with an outside.

However, in the prior art, the sound emitted by the speaker unit generates an airflow sound when passing through the hollow sound channel. The airflow sound is mixed into the sound emitted by the speaker unit, so that an acoustic performance of the mobile terminal is deteriorated.

Therefore, it is necessary to provide a mobile terminal to solve above technical problems.

BRIEF DESCRIPTION OF DRAWINGS

In order to more clearly illustrate technical solutions in embodiments of the present invention, the drawings used in the description of the embodiments will be briefly described below. Apparently, the drawings in the following description are merely some of the embodiments of the present invention, and those skilled in the art are able to obtain other drawings according to the drawings without contributing any inventive labor. In the drawing.

DETAILED DESCRIPTION OF THE EXEMPLARY EMBODIMENT

The technical solution in the embodiment of the present invention will be clearly and completely described in conjunction with the drawings in the embodiments of the present invention. It is obvious that the described embodiment is only a part of the embodiment of the present invention, and not all of them. All other embodiments obtained by those skilled in the art based on the embodiment of the present invention without creative efforts are within the scope of the present invention.

Figure 1:
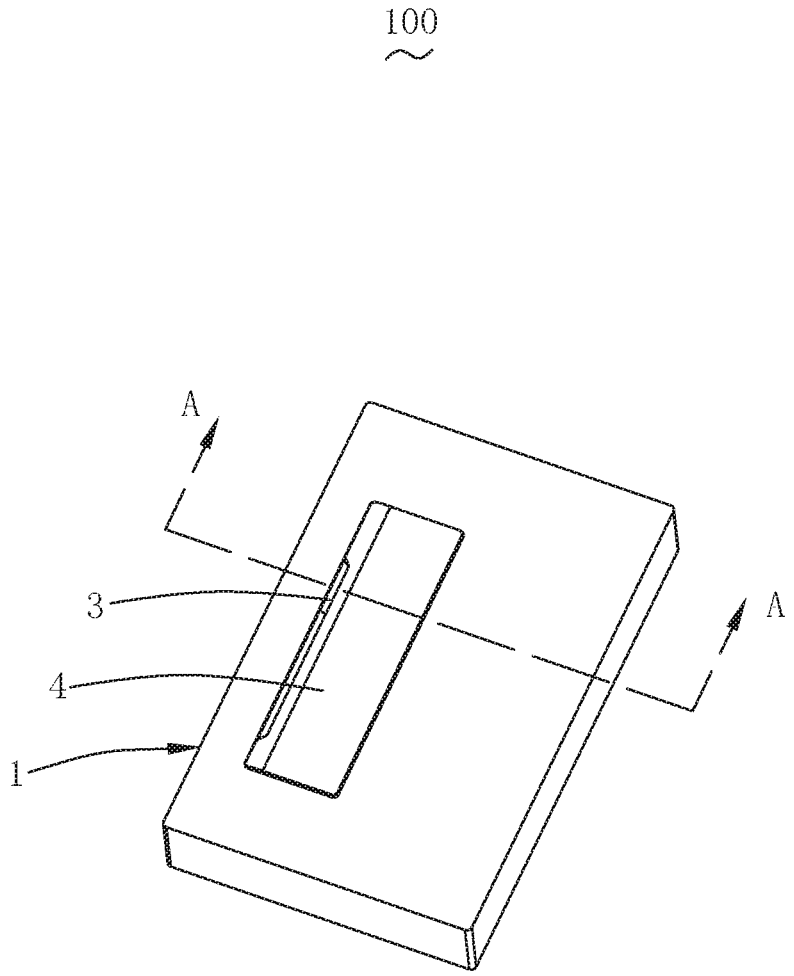
FIG. 1 is a schematic perspective view of a mobile terminal according to the embodiment of the present invention.
Figure 2:
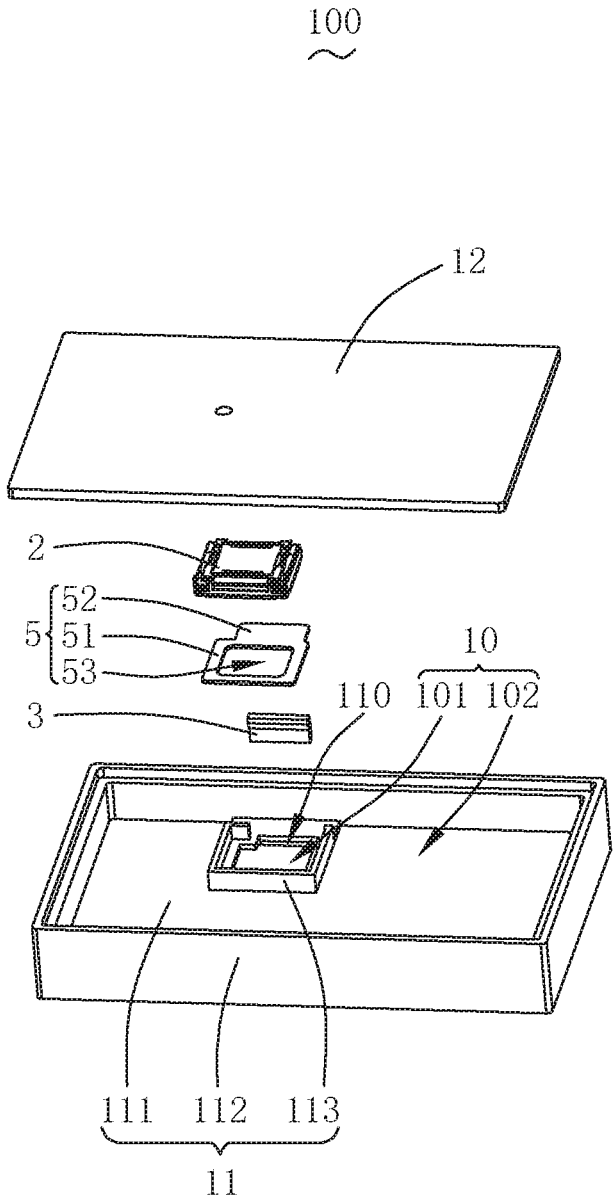
FIG. 2 is an exploded perspective view showing a portion of the mobile terminal of the embodiment of the present invention.

As shown in FIGS. 1-2, the present invention provides a mobile terminal 100. The mobile terminal 100 comprises a housing 1, a speaker unit 2, a sound absorbing material 3, and a cover plate 4.

The housing 1 comprises an accommodating space 10. The housing 1 may be intergrally formed as one part or assembled with separate parts. For example, in the present invention, the housing 1 is assembled with separate parts. To be specific, the housing 1 comprises an upper cover 11, a lower cover 12 covered on the upper cover 11 to cooperatively form the accommodating space 10.

To be specific, the upper cover 11 comprises an upper cover plate 111, a side wall 112, and a supporting wall 113. The side wall 112 extends from a peripheral edge of the upper cover plate 111 toward the lower cover 12 and abuts against the lower cover 12. The supporting wall 113 extends from the upper cover plate 111 toward the lower cover 12 and spaced apart from the lower cover 12. The lower cover 12 covers on a side of the side wall 112 away from the upper cover plate 111.

Figure 3:
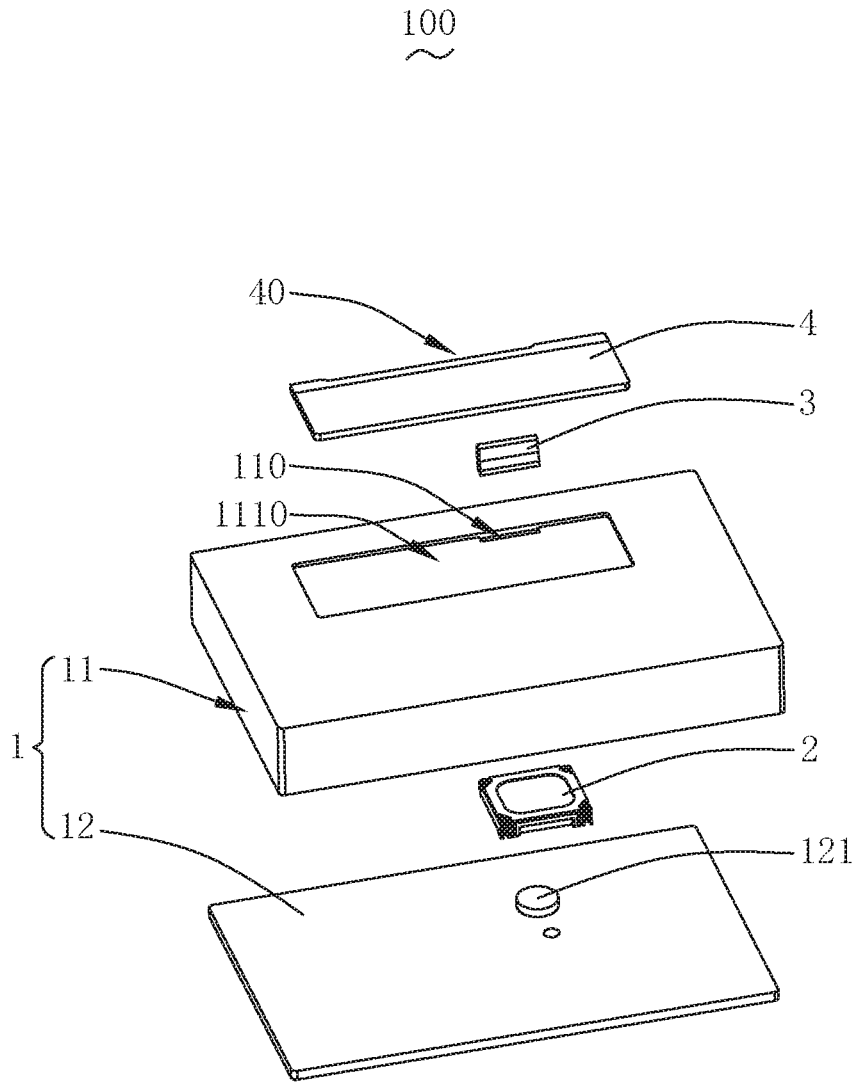
FIG. 3 is an exploded perspective view showing a portion of the mobile terminal of the present invention, viewed from another angle.
Figure 4:
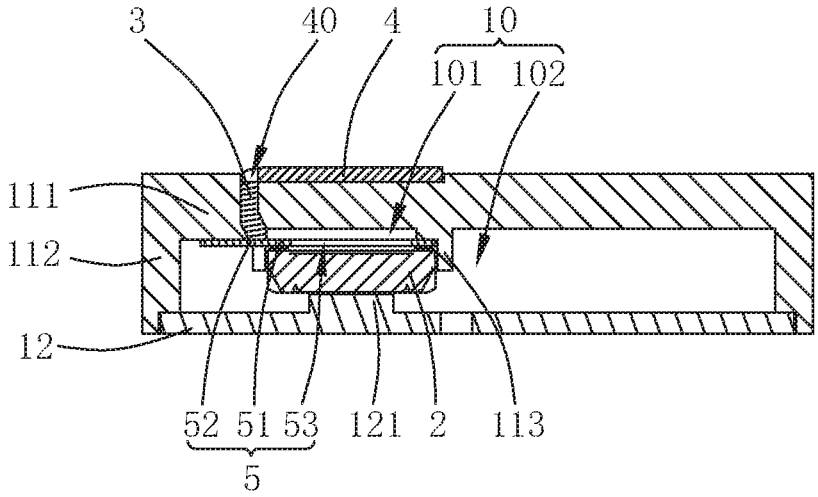
FIG. 4 is a cross sectional view taken along a line A-A shown in FIG. 1.

As shown in FIGS. 3-4, the speaker unit is accommodated in the accommodating space 10 of the housing 1. The speaker unit 2 divides the accommodating space 10 into a front sound cavity 101 and a rear cavity 102. The housing 1 comprises a sound channel 110 penetrating through therein. The sound channel 110 communicates the front sound cavity 101 with an outside.

To be specific, the lower cover 12, the upper cover 11, and the speaker unit 2 are enclosed together to form the rear cavity 102, and the rear cavity 102 is configured to improve low frequency acoustic performance of the mobile terminal 100. The sound channel 110 penetrates through the upper cover plate 111. The speaker unit 2 is supported by the supporting wall 113 and is spaced apart from the upper cover plate 111. The speaker unit 2, the upper cover plate 111, and the supporting wall 113 are enclosed together to form the front sound cavity 101.

Furthermore, a side of the upper cover plate 111 away from the lower cover 12 is recessed to form a sound emitting groove 1110. And the cover plate 4 covers on the sounding groove 1110. And one side of the cover plate 4 is recessed to form a avoiding opening 40. The avoiding opening 40 communicates with the sound channel 110.

Furthermore, the housing 1 further comprises a supporting plate 5 fixed to the supporting wall 113 and covering the sound channel 110. To be specific, the supporting plate 5 comprises a supporting plate main body 51, an extending wall 52, and a through hole 53 penetrating through the supporting plate main body 51. The supporting plate main body 51 fixes the supporting wall 113 and is connected with the speaker unit 2. The extending wall 52 extends from the supporting plate main body 51 toward the side wall 112 and covers the sound channel 110. The speaker unit 2 is accommodated in the supporting wall 113 and attached to the supporting plate main body 51. The sound absorbing material 3 is fixedly supported by the extending wall 52. The upper cover plate 111, the supporting plate 5, the supporting wall 113, and the speaker unit 2 are enclosed together to form the front sound cavity 101 communicating with the through hole 53. And the sound channel 110 and the front sound cavity 10 coorperatively form a side sounding structure.

It should be noted that the sound emitted by the speaker unit 2 is air-transmitted and sequentially propagates outward via the front sound cavity 101 and the sound channel 110, and the air carrying the sound passes through the sound channel 110 to generate an airflow sound due to friction.

In the present embodiment, in order to prevent the airflow sound from mixing the sound emitted by the speaker unit, the sound channel 110 is filled with the sound absorbing material 3. To be specific, the sound absorbing material 3 is sound absorbing cotton. With such configuration of the sound absorbing material 3, the airflow sound is absorbed by the sound absorbing material 3, and the airflow sound is prevented from being mixed into the sound emitted by the sounding device 2, thereby making the acoustic performance of the mobile terminal 100 excellent.

It is worth mentioning that, in order to make an assembly of the speaker unit 2 more reliable, a side of the lower covers 2 adjacent to the upper cover plate 111 extends toward the speaker unit 2 to form an extending post 121. And the extending post 121 abuts against the speaker unit 2. With such configuration of the extending post 121, movement of the speaker unit 2 in a vibration direction is effectively avoided during a vibration sounding process, so that the assembly of the speaker unit 2 is more reliable, which improves a reliability of the mobile terminal 100.

Compared with the prior art, in the mobile terminal of the present invention, the sound channel is filled with the sound absorbing material, and the sound absorbing material absorbs the airflow sound. The airflow sound is generated when the sound emitted by the sounding device passes through the sound channel. The airflow sound is absorbed by the sound absorbing material, and the airflow sound is prevented from being mixed into the sound emitted by the sounding device when the sound passes through the sound channel, thus, the acoustic performance of the mobile terminal is optimized.

The above is only the embodiments of the present invention, and it should be noted that those skilled in the art can make improvements without departing from the concept of the present invention, which are all within the scope of the present invention.

What is claimed is:

1. A mobile terminal, comprising:

a housing comprising an upper cover, a lower cover covering the upper cover to form an accommodating space, and a sound channel penetrating through the upper cover; and a speaker unit accommodated in the accommodating space of the housing;

the speaker unit dividing the accommodating space into a front sound cavity and a rear cavity;

the sound channel communicating the front sound cavity with an outside; and wherein, the sound channel is filled with a sound absorbing material; and wherein, the upper cover comprises an upper cover plate, a side wall, and a supporting wall; the side wall extends from a peripheral edge of the upper cover plate toward the lower cover and abuts against the lower cover; the supporting wall extends from the upper cover plate toward the lower cover and spaced apart from the lower cover; the sound channel penetrates through the upper cover plate; the speaker unit is supported by the supporting wall and spaced apart from the upper cover plate; and wherein, the housing further comprises a supporting plate fixed to the supporting wall and covering the sound channel; the upper cover plate, the supporting plate, the supporting wall, and the speaker unit are enclosed together to form the front sound cavity; the supporting plate comprises a supporting plate main body, an extending wall, and a through hole; the supporting plate main body is fixed on the supporting wall and connected with the speaker unit the extending wall extends from the supporting plate main body toward the side wall and covers the sound channel; the through hole penetrates the supporting plate main body and communicating with the front sound cavity; the sound absorbing material is fixedly supported by the extending wall.

2. The mobile terminal according to the claim 1, wherein the sound absorbing material is sound absorbing cotton.

3. The mobile terminal according to the claim 1, wherein a side of the lower cover adjacent to the upper cover plate extends toward the speaker unit to form an extending post, and the extending post abuts against the speaker unit.

4. The mobile terminal according to the claim 1, wherein a side of the upper cover plate away from the lower cover is recessed to form a sound emitting groove; and the housing further comprises a cover plate covering the sound emitting groove; and one side of the cover plate is recessed to form an avoiding opening; the avoiding opening communicates with the sound channel.

* * * * *